US009890667B2

(12) United States Patent
Oh et al.

(10) Patent No.: US 9,890,667 B2
(45) Date of Patent: Feb. 13, 2018

(54) CVVT APPARATUS FOR ENGINE

(71) Applicants: Hyundai Motor Company, Seoul (KR); Kia Motors Corp., Seoul (KR)

(72) Inventors: Chung Han Oh, Seongnam-Si (KR); Min Su Park, Paju-Si (KR); Yun Seok Kim, Yongin-Si (KR)

(73) Assignees: Hyundai Motor Company, Seoul (KR); Kia Motor Corp., Seoul (KR)

( * ) Notice: Subject to any disclaimer, the term of this patent is extended or adjusted under 35 U.S.C. 154(b) by 125 days.

(21) Appl. No.: 14/959,839

(22) Filed: Dec. 4, 2015

(65) Prior Publication Data

US 2017/0022852 A1 Jan. 26, 2017

(30) Foreign Application Priority Data

Jul. 23, 2015 (KR) ..... 10-2015-0104648

(51) Int. Cl.
*F01L 1/34* (2006.01)
*F01L 1/344* (2006.01)

(52) U.S. Cl.
CPC ..... *F01L 1/3442* (2013.01); *F01L 2001/3443* (2013.01); *F01L 2001/34463* (2013.01); *F01L 2001/34469* (2013.01); *F01L 2250/02* (2013.01); *F01L 2800/00* (2013.01)

(58) Field of Classification Search
CPC ..... F01L 1/3442; F01L 2001/34426; F01L 2001/3443; F01L 2001/34463; F01L 2001/34469
USPC ..... 123/90.15, 90.17
See application file for complete search history.

(56) References Cited

U.S. PATENT DOCUMENTS 7,387,097 B2 * 6/2008 Schmitt ..... F01L 1/022 123/90.17

FOREIGN PATENT DOCUMENTS

| | | | |
|---|---|---|---|
| JP | 11-223112 | A | 8/1999 |
| JP | 2014-80884 | A | 5/2014 |
| KR | 2001-0030066 | A | 4/2001 |
| KR | 10-2004-0050307 | A | 6/2004 |
| KR | 10-2011-0132104 | A | 12/2011 |

* cited by examiner

*Primary Examiner* — Ching Chang
(74) *Attorney, Agent, or Firm* — Morgan, Lewis & Bockius LLP

(57) ABSTRACT

A Continuous Variable Valve Timing (CVVT) apparatus for an engine may include a housing, a rotor disposed to be rotatable relative to the housing, a locking pin passing through a facing relatively rotating surface between the housing and the rotor by elastic force so as to restrict rotation of the rotor relative to the housing by linear movement, and an oil control valve disposed such that oil is supplied to an advance chamber and a delay chamber provided between the rotor and the housing, in which, when a control duty value applied to the oil control valve is "0", the oil control valve is fixed in a state in which the oil is supplied to the advance chamber.

7 Claims, 3 Drawing Sheets

CVVT APPARATUS FOR ENGINE

CROSS REFERENCE TO RELATED APPLICATION

The present application claims priority to Korean Patent Application No. 10-2015-0104648 filed Jul. 23, 2015, the entire contents of which is incorporated herein for all purposes by this reference.

BACKGROUND OF THE INVENTION

Field of the Invention

The present invention relates to a Continuous Variable Valve Timing (CVVT) apparatus for an engine, and, more particularly, to an intermediate phase CVVT technique for fixing a phase of a CVVT apparatus in a specific state in an operating region in which a valve timing is not actively adjusted.

Description of Related Art

When an engine is driven in an Atkinson cycle, compression work may be reduced and thus fuel efficiency may be improved. A CVVT apparatus is utilized to realize the Atkinson cycle in a typical Otto-cycle engine.

That is, when the closing of an intake valve in a conventional Otto-cycle engine is delayed using a CVVT apparatus, compared to that in a typical engine, a compression stroke, in which energy for compressing air is consumed when a piston moves toward a top dead point, is practically decreased. Thus, the compression work of the engine may be relatively reduced compared to when the intake valve is not closed due to a delay, so that fuel efficiently may be improved.

However, since the CVVT apparatus is generally operated by hydraulic pressure produced using the power of the engine, it is difficult to actively control the CVVT apparatus when the engine is started.

In addition, when a valve timing is not actively controlled by the CVVT apparatus in the operating region during the idling of the engine, it is advantageous to fuel efficiency since energy consumption is rather small.

Accordingly, the CVVT apparatus is in a default state in which the CVVT apparatus is not actively controlled when the engine is started and idles.

In the engine equipped with the CVVT apparatus, which is configured to adjust the phase of an intake camshaft enough to realize the Atkinson cycle, when the default state is formed in which the CVVT apparatus is not actively controlled by hydraulic pressure, the CVVT apparatus is maintained in the most delayed state by resistance to driving of the intake camshaft. In this case, since the intake valve is delayed and closed in the most delayed state, there is a lack of compression pressure, resulting in faulty starting of the engine and poor combustion during the idling of the engine.

Therefore, it is necessary to fix the CVVT apparatus in the state in which the intake valve timing of the typical Otto-cycle engine is realized, for example so as to be suitable for the engine, in the operating region, in which the CVVT apparatus is not actively controlled, such as in the operating region when the engine is started or idles. To this end, there is disclosed an intermediate phase CVVT apparatus including a locking pin and a locking groove, which fix the phase of a rotor relative to a housing of the CVVT apparatus in a proper state by elastic force even though no hydraulic pressure for controlling the CVVT apparatus is supplied.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a Continuous Variable Valve Timing (CVVT) apparatus for an engine, in particular an intermediate phase CVVT apparatus capable of having improved operational stability by enabling a locking pin to be smoothly locked or unlocked when the intermediate phase CVVT apparatus is fixed to be in an intermediate phase state by self locking or is released therefrom.

According to various aspects of the present invention, a CVVT apparatus for an engine may include a housing, a rotor disposed to be rotatable relative to the housing, a locking pin passing through a facing relatively rotating surface between the housing and the rotor by elastic force so as to restrict rotation of the rotor relative to the housing by linear movement, and an oil control valve disposed such that oil is supplied to an advance chamber and a delay chamber provided between the rotor and the housing, in which, when a control duty value applied to the oil control valve is "0", the oil control valve may be fixed in a state in which the oil is supplied to the advance chamber.

The oil control valve may be supplied with oil from an oil pump, and may be configured to controllably supply the supplied oil to the advance and delay chambers by a solenoid operated in response to control duty provided from a controller, and a return spring for providing elastic force.

The oil control valve may be a four-port valve comprising an inlet port for receiving oil from the oil pump, an advance port to communicate with the advance chamber, a delay port to communicate with the delay chamber, and a drain port for draining oil.

The oil control valve may be a four-port and three-position solenoid valve that realizes a first position at which, when the control duty value applied to the oil control valve from the controller is "100", the inlet port is connected to the delay port and the advance port is connected to the drain port, a second position at which, when the control duty value applied to the oil control valve from the controller is a value which is greater than "0" and less than "100", the inlet port is connected to the advance and delay ports such that a communication ratio therebetween varies according to a variation of the control duty value, and a third position at which, when the control duty value applied to the oil control valve from the controller is "0", the inlet port is connected to the advance port and the delay port is connected to the drain port by elastic force of the return spring.

According to various aspects of the present invention, a CVVT apparatus for an engine may include a CVVT actuator configured such that a phase of a rotor relative to a housing is fixed midway between a most advanced angle and a most delayed angle, an oil control valve disposed to supply a hydraulic pressure for controlling the CVVT actuator, and a controller disposed to control the oil control valve, in which, when a control duty value of the controller is "0", the oil control valve may be configured to supply oil toward an advance chamber of the CVVT actuator.

As apparent from the above description, when the intermediate phase CVVT apparatus is fixed to be in an intermediate phase state by self locking or is released therefrom, the locking pin can be smoothly locked or unlocked, thereby enabling the operational stability of the CVVT apparatus to be improved.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

A Continuous Variable Valve Timing (CVVT) apparatus for an engine according to various embodiments of the present invention will be described below with reference to the accompanying drawings.

Figure 1:
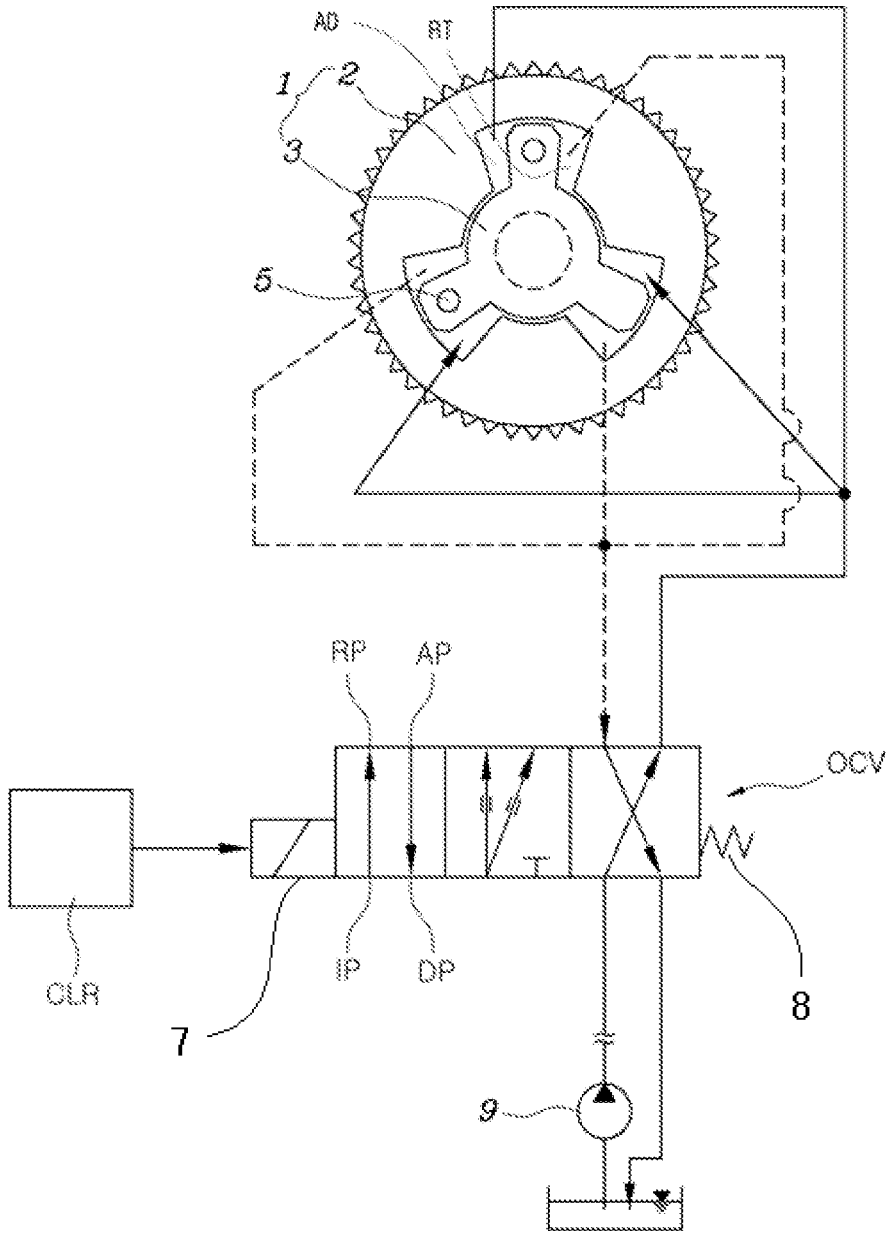
FIG. 1 is a view for explaining an exemplary Continuous Variable Valve Timing (CVVT) apparatus for an engine according to the present invention, and illustrating a state in which an oil control valve is operated at a third position.
Figure 2:
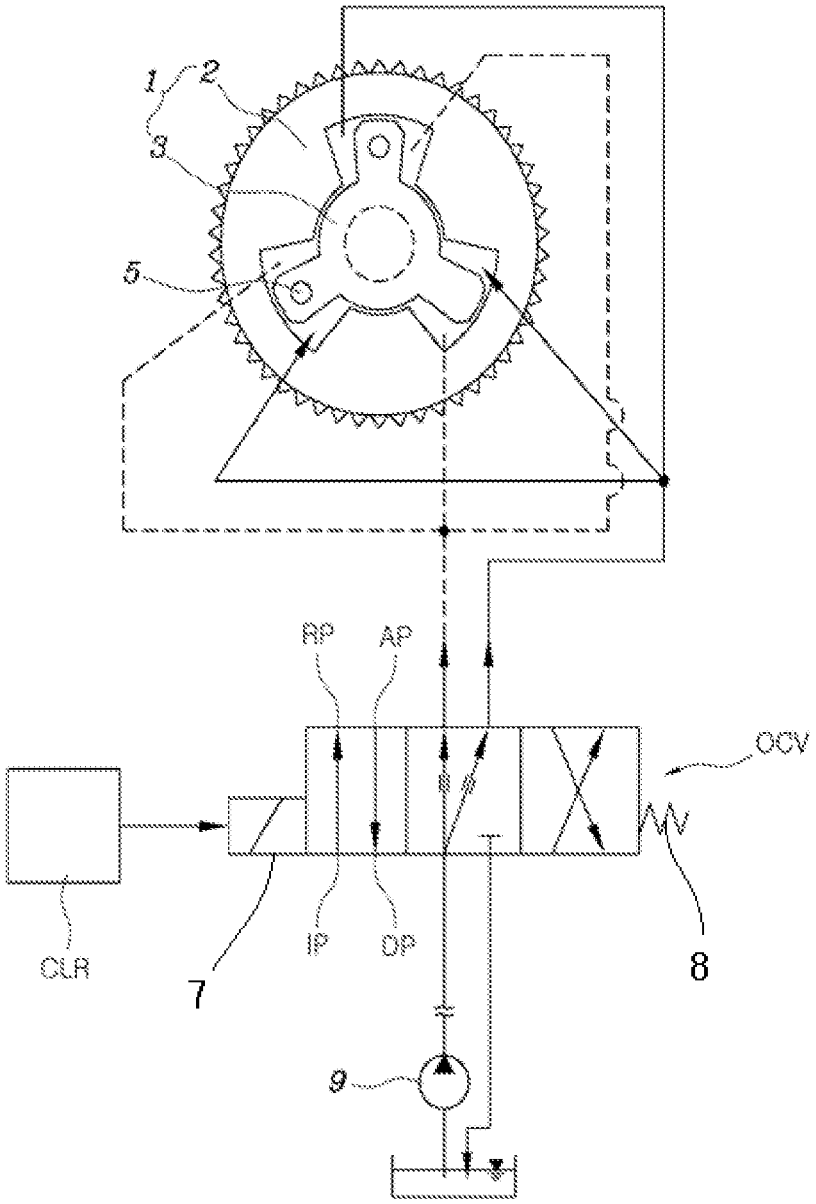
FIG. 2 is a view for explaining a state in which the oil control valve in FIG. 1 is operated at a second position.
Figure 3:
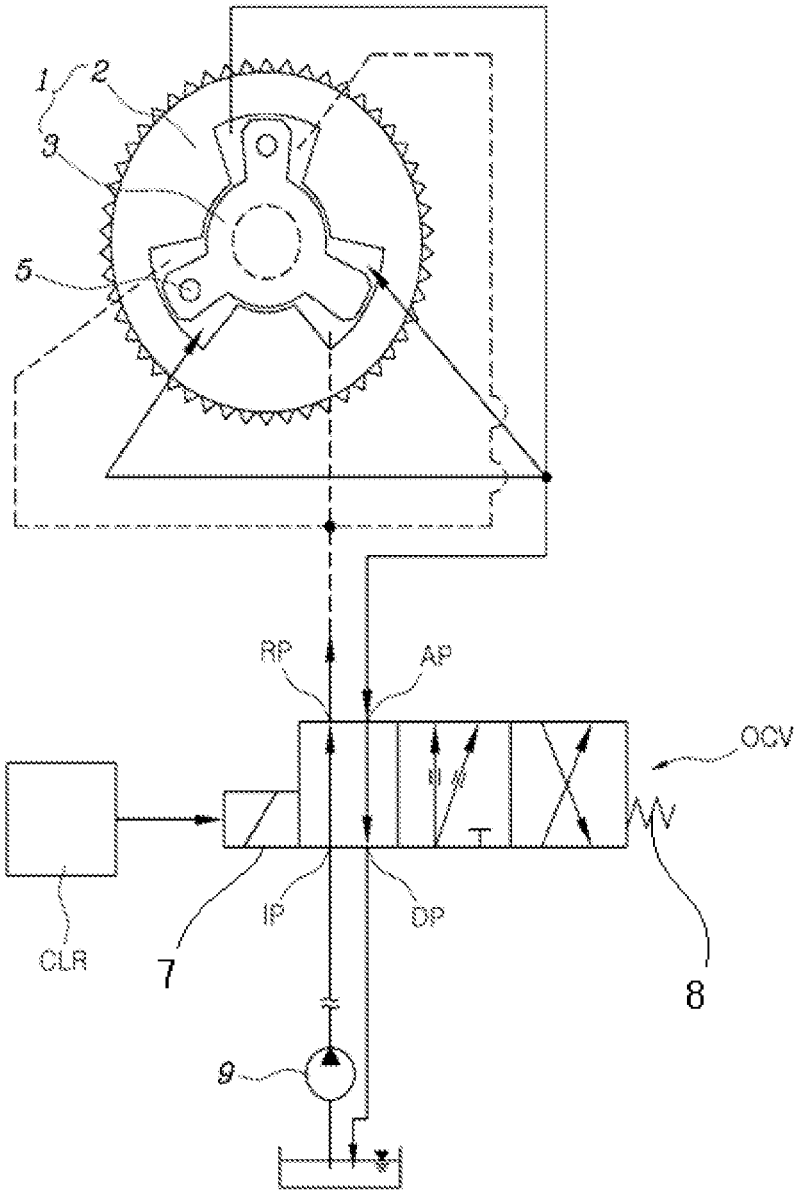
FIG. 3 is a view for explaining a state in which the oil control valve in FIG. 1 is operated at a first position.

Referring to FIG. 1, a CVVT apparatus for an engine according to various embodiments of the present invention includes a housing 2, a rotor 3 which is installed to be rotatable relative to the housing 2, a locking pin 5 which passes through a facing relatively rotating surface between the housing 2 and the rotor 3 by elastic force so as to restrict the rotation of the rotor 3 relative to the housing 2 by linear movement, and an oil control valve OCV installed such that oil may be supplied to an advance chamber AD and a delay chamber RT which are provided between the rotor 3 and the housing 2.

Here, when a control duty value applied to the oil control valve OCV is "0", the oil control valve OCV is fixed in the state in which oil is supplied to the advance chamber AD.

Assuming that the configuration including the housing 2 and the rotor 3 is referred to as a CVVT actuator 1, the present invention includes a CVVT actuator 1 configured such that the phase of the rotor 3 relative to the housing 2 may be fixed midway between the most advanced angle and the most delayed angle, an oil control valve OCV which is installed to supply a hydraulic pressure for controlling the CVVT actuator 1, and a controller CLR which is installed to control the oil control valve OCV. In this case, when the control duty value of the controller is "0", the oil control valve OCV serves to supply oil toward the advance chamber AD of the CVVT actuator 1.

That is, the CVVT actuator 1 includes the housing 2 and the rotor 3, and the advance chamber AD and the delay chamber RT are formed between the housing 2 and the rotor 3, as described above. Consequently, when a hydraulic pressure is supplied to the advance chamber AD or the delay chamber RT, the phase of the rotor 3 relative to the housing 2 is advanced or delayed.

The housing 2 is driven using the power of a crankshaft transferred by a power transfer mechanism such as a chain, so as to interlock with the crankshaft of an engine. The rotor 3 is connected integrally with a camshaft. When the phase of the rotor 3 relative to the housing 2 is advanced or delayed, the phase of a cam, which is rotated by the camshaft, is thus changed. Therefore, the switching time of an intake valve may be adjusted in an intake cam, and the switching time of an exhaust valve may be advanced or delayed in an exhaust cam.

The locking pin 5 may be installed to be continuously fixed, without using hydraulic control by the oil control valve OCV, in an intermediate state in which the rotor 3 is not maximally delayed and advanced relative to the housing 2.

For example, the locking pin 5 is installed to be linearly movable toward the housing 2 from the rotor 3. The locking pin 5 is elastically supported by an elastic member such as a spring so as to be directed toward the housing 2. The housing has a locking groove to which the locking pin 5 is coupled. When the phase of the rotor 3 relative to the housing 2 is adapted, self locking is performed in which the locking pin 5 is coupled to the locking groove by the elastic force of the elastic member. In this state, the self locking is consistently maintained even though oil for controlling the CVVT actuator 1 is not supplied thereto, and thus the engine can be stably controlled.

When a hydraulic pressure is supplied to the CVVT actuator enough to actively control the CVVT actuator, the locking pin 5 is released by the hydraulic pressure.

The oil control valve OCV serves to controllably supply the oil, supplied thereto, to the advance and delay chambers AD and RT, by a solenoid 7, which is operated in response to a control duty value provided from the controller CLR, and a return spring 8 for providing elastic force.

The oil control valve OCV is a four-port valve which includes an inlet port IP for receiving oil from an oil pump 9, an advance port AP communicating with the advance chamber AD, a delay port RP communicating with the delay chamber RT, and a drain port DP for draining oil.

The oil control valve OCV is a four-port and three-position solenoid valve that realizes a first position, at which, when the control duty value applied to the valve from the controller is "100", the inlet port IP is connected to the delay port RP and the advance port AP is connected to the drain port DP, a second position, at which, when the control duty value applied to the valve from the controller is a value which is greater than "0" and less than "100", the inlet port IP is connected to the advance and delay ports AP and RP such that a communication ratio therebetween varies according to the variation of the control duty value, and a third position, at which, when the control duty value applied to the valve from the controller is "0", the inlet port IP is connected to the advance port AP and the delay port RP is connected to the drain port DP by the elastic force of the return spring 8.

That is, at the first position, the pressure of oil supplied from the oil pump is provided to the delay port, and the oil at the advance port AP is discharged to the drain port DP, so that the CVVT actuator is in the most delayed state.

At the second position, the pressure of oil supplied from the oil pump 9 is divided and supplied to the advance and delay ports AP, RP according to the control duty value controlled by the controller CLR. Thus, in this position, a valve timing can be continuously changed in response to the continuous variation of the control duty value, thereby enabling a CVVT function to be practically realized.

The third position corresponds to a section in which the CVVT control is not performed, for example, an operating region when the engine is started or idles. At the third position, when the control duty value of the oil control valve is "0", oil is supplied from the oil pump 9, and the pressure of the oil is supplied to the advance chamber.

For reference, the first, second, and third positions are sequentially illustrated from the left of the oil control valve OCV in FIG. 1. When a current applied to the solenoid 7 is completely blocked, the oil control valve OCV is operated at the third position, and thus the inlet port IP is connected to the advance port AP by the elastic force of the return spring 8.

As described above, when the hydraulic pressure is supplied to the advance chamber AD when the control duty value of the oil control valve OCV is "0", the hydraulic pressure is applied in a direction that cancels out cam torque acting on the CVVT actuator 1. Thus, when the locking pin 5 is locked by itself or the locking pin 5 is unlocked by a hydraulic pressure which is supplied again thereto, the locking pin 5 can be smoothly operated.

That is, when a hydraulic pressure for actively controlling the CVVT actuator 1 is not applied thereto from the oil control valve OCV, the CVVT actuator tends to be in a delayed state in which the rotation phase of the rotor 3 relative to the housing 2 is delayed by cam torque as a load required for the rotation of the camshaft. Accordingly, when the cam torque is applied to the CVVT actuator, the locking pin 5 is subjected to pressure in a direction perpendicular to the linear movement direction for locking and unlocking between the rotor 3 and the housing 2, namely in the transverse direction of the locking pin 5. For this reason, the locking pin 5 may not be smoothly and linearly moved when the locking pin 5 is locked by itself or unlocked. To resolve this, the pressure of oil provided from the oil pump 9 is supplied to the advance chamber AD as described above, with the consequence that the cam torque can be canceled out. Consequently, the locking pin 5 can be smoothly operated.

Accordingly, when the pressure of oil provided from the oil pump 9 is supplied to the advance chamber AD when the control duty value of the oil control valve OCV is "0", the present invention can have an effect of improving the operational stability of the locking pin 5 in the intermediate phase CVVT apparatus.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A Continuous Variable Valve Timing (CVVT) apparatus for an engine, comprising:

a housing including an advance chamber and a delay chamber;

a rotor disposed in the advance chamber and the delay chamber to be rotatable relative to the housing;

a locking pin passing through a facing relatively rotating surface between the housing and the rotor by elastic force so as to restrict rotation of the rotor relative to the housing by linear movement; and an oil control valve including an advance port and a delay port and disposed to selectively communicate the advance port or the delay port with the advance chamber or the delay chamber by oil such that the oil is supplied to the advance chamber and the delay chamber, wherein, when a control duty value applied to the oil control valve is "0", the oil control valve is fixed in a state in which the oil is supplied to the advance chamber.

2. The CVVT apparatus according to claim 1, wherein the oil control valve is supplied with oil from an oil pump, and is configured to controllably supply the supplied oil to the advance and delay chambers by a solenoid operated in response to control duty provided from a controller configured to control the oil control valve, and a return spring for providing elastic force.

3. The CVVT apparatus according to claim 2, wherein the oil control valve is a four-port valve comprising an inlet port for receiving oil from the oil pump, the advance port to communicate with the advance chamber, the delay port to communicate with the delay chamber, and a drain port for draining oil.

4. The CVVT apparatus according to claim 3, wherein the oil control valve is a four-port and three-position solenoid valve that realizes:

a first position at which, when the control duty value applied to the oil control valve from the controller is "100", the inlet port is connected to the delay port and the advance port is connected to the drain port;

a second position at which, when the control duty value applied to the oil control valve from the controller is a value which is greater than "0" and less than "100", the inlet port is connected to the advance and delay ports such that a communication ratio therebetween varies according to a variation of the control duty value; and a third position at which, when the control duty value applied to the oil control valve from the controller is "0", the inlet port is connected to the advance port and the delay port is connected to the drain port by elastic force of the return spring.

5. A Continuous Variable Valve Timing (CVVT) apparatus for an engine, comprising:

a CVVT actuator configured such that a phase of a rotor relative to a housing including an advance chamber and a delay chamber is fixed midway between a most advanced angle and a most delayed angle;

an oil control valve including an advance port and a delay port and disposed to selectively communicate the advance port or the delay port with the advance chamber or the delay chamber by oil to supply a hydraulic pressure for controlling the CVVT actuator; and a controller disposed to control the oil control valve, wherein, when a control duty value of the controller is "0", the oil control valve is configured to supply the oil toward the advance chamber of the CVVT actuator.

6. The CVVT apparatus according to claim 5, wherein the oil control valve is a four-port valve comprising an inlet port for receiving oil from an oil pump, the advance port to communicate with the advance chamber, the delay port to communicate with the delay chamber, and a drain port for draining oil.

7. The CVVT apparatus according to claim 6, wherein the oil control valve is a four-port and three-position solenoid valve that realizes:

a first position at which, when the control duty value applied to the oil control valve from the controller is "100", the inlet port is connected to the delay port and the advance port is connected to the drain port;

a second position at which, when the control duty value applied to the oil control valve from the controller is a value which is greater than "0" and less than "100", the inlet port is connected to the advance and delay ports such that a communication ratio therebetween varies according to a variation of the control duty value; and a third position at which, when the control duty value applied to the oil control valve from the controller is "0", the inlet port is connected to the advance port and the delay port is connected to the drain port by elastic force of a return spring.

* * * * *